US008535126B2

(12) United States Patent
Fincher et al.

(10) Patent No.: US 8,535,126 B2
(45) Date of Patent: Sep. 17, 2013

(54) AIR FLOW CONTROL MECHANISM AND METHODS

(76) Inventors: Roger W. Fincher, Conroe, TX (US); Peter S. Aronstam, Houston, TX (US)

( * ) Notice: Subject to any disclaimer, the term of this patent is extended or adjusted under 35 U.S.C. 154(b) by 1219 days.

(21) Appl. No.: 12/369,668

(22) Filed: Feb. 11, 2009

(65) Prior Publication Data

US 2009/0209195 A1 Aug. 20, 2009

Related U.S. Application Data

(60) Provisional application No. 61/029,228, filed on Feb. 15, 2008.

(51) Int. Cl.
*F24F 13/08* (2006.01)

(52) U.S. Cl.
USPC ..... 454/258; 454/278; 454/334; 251/329

(58) Field of Classification Search
USPC ..... 454/256, 258, 275, 276, 278, 333, 454/334; 236/49.3, 51; 251/329
See application file for complete search history.

(56) References Cited

U.S. PATENT DOCUMENTS

| | | | | |
|---|---|---|---|---|
| 4,743,739 | A * | 5/1988 | Tateishi | 392/365 |
| 6,271,486 | B1 * | 8/2001 | Franklin et al. | 177/105 |
| 7,347,774 | B2 * | 3/2008 | Aronstam et al. | 454/258 |
| 7,413,163 | B2 * | 8/2008 | Maxwell et al. | 251/250 |
| 2004/0166797 | A1 * | 8/2004 | Thrasher et al. | 454/290 |
| 2005/0161517 | A1 * | 7/2005 | Helt et al. | 236/1 C |
| 2006/0105697 | A1 * | 5/2006 | Aronstam et al. | 454/256 |
| 2009/0302252 | A1 * | 12/2009 | Cheung | 251/212 |

* cited by examiner

*Primary Examiner* — John K Fristoe, Jr.
*Assistant Examiner* — R. K. Arundale
(74) *Attorney, Agent, or Firm* — Patterson & Sheridan, LLP

(57) ABSTRACT

The invention relates to a method and mechanism to control air flow through an air handling system. In one aspect, a flow control device for use in an air handling system is provided. The device includes a flow control member having segmented sliding gates, wherein the flow control member is configured to selectively control an air flow stream by moving the sliding gates into the path of the air flow stream. The device further includes a controller member configured to control the movement of the sliding gates. Furthermore, the device includes a communication member configured to send and receive signals regarding the control of the air flow stream. Additionally, the device includes a power member for supplying power to the flow control member, the controller member and the communication member. In another aspect, a method of controlling an air flow stream in an air handling system is provided.

20 Claims, 15 Drawing Sheets

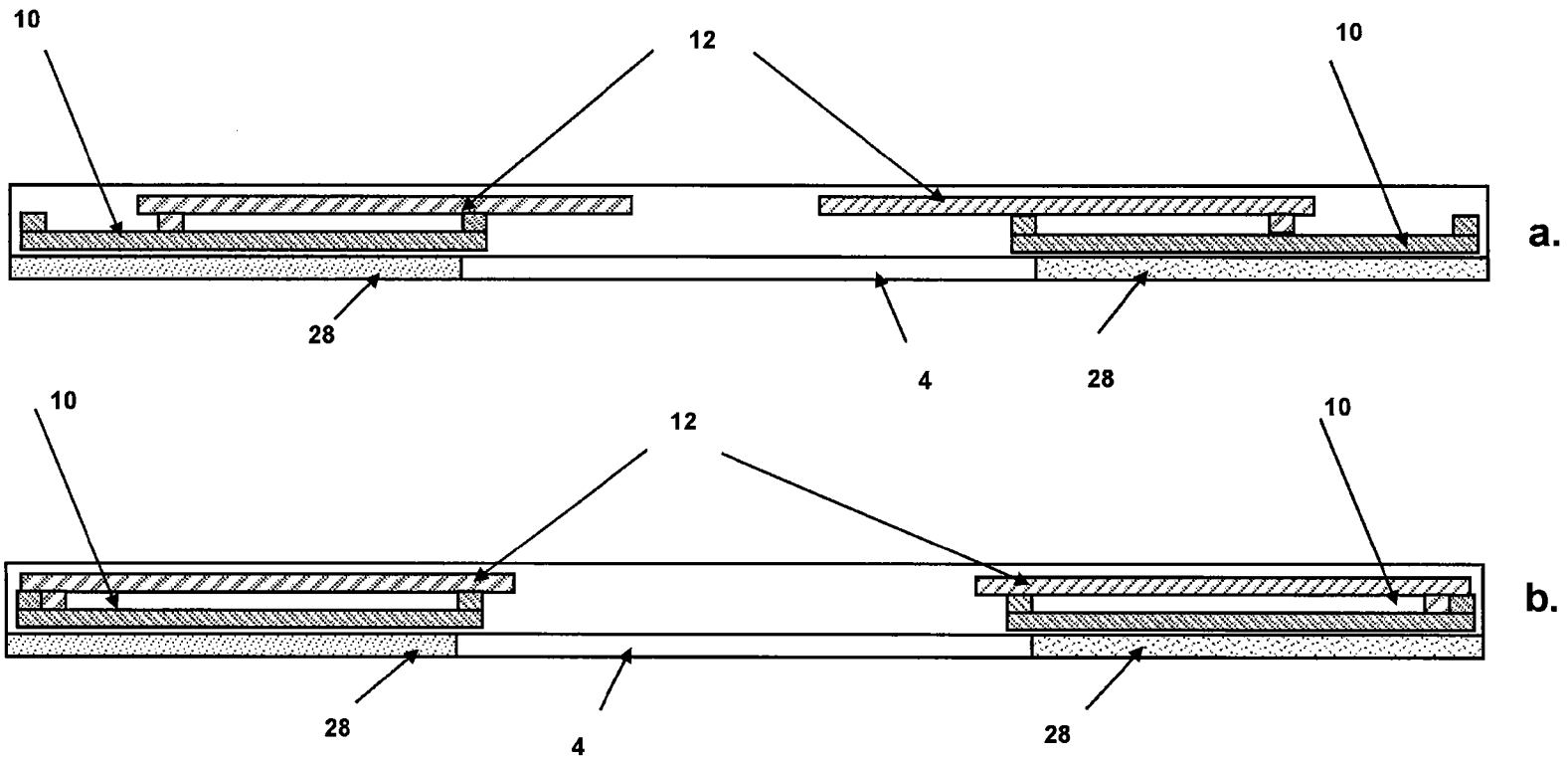
Fig 3a,b.

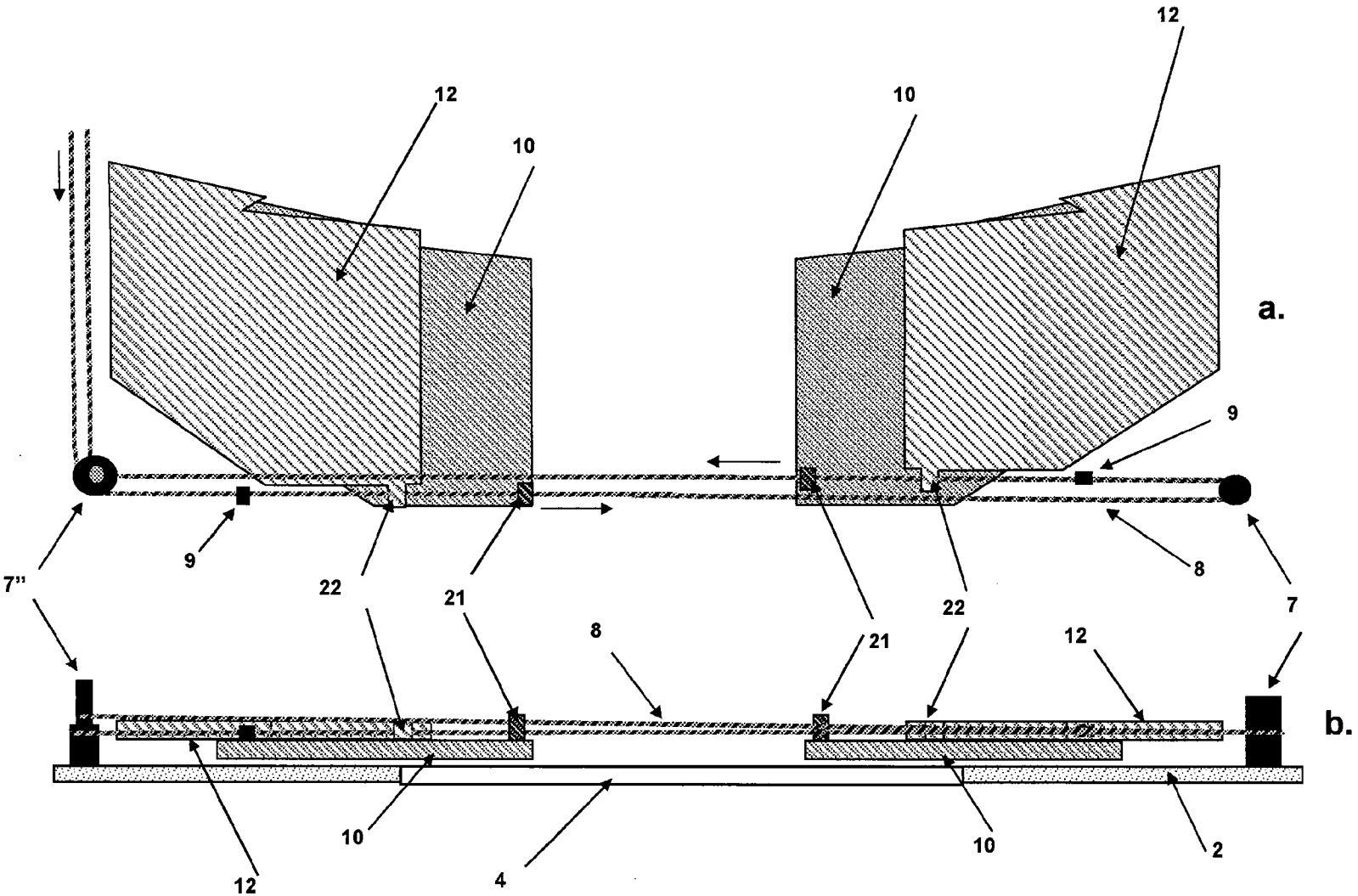
Fig 5a,b.

AIR FLOW CONTROL MECHANISM AND METHODS

CROSS-REFERENCE TO RELATED APPLICATIONS

This application claims benefit of U.S. provisional patent application Ser. No. 61/029,228, filed Feb. 15, 2008, which is herein incorporated by reference.

BACKGROUND OF THE INVENTION

1. Field of the Invention

Embodiments of the present invention generally relate to heating, ventilating, and air conditioning systems. More particularly, the invention relates to a method and mechanism to control flow through heating, ventilating, and air conditioning duct systems.

2. Description of the Related Art

The control of air flow in heating, cooling, and ventilation applications has become more complex as building and home automation and energy management options increase. Most current air handling systems rely on fixed regulation devices such as variable setting louvers associated with diffusers in register boxes or automated dampers within the distribution piping. To some degree dampers may be controlled by the air handling controllers used in commercial buildings; however, most residential systems use fixed dampers that are set once during system start-up and then never adjusted or changed. In both the commercial and residential application, changes to layout or use of the building that occur over the life of the structure typically alter the air balance that was originally created or programmed into automated controllers. It is typical that these original settings and control parameters are not often changed or up-dated and therein air flow balance, comfort, and energy management suffer as the building ages and the use changes.

In recent years, several products have entered the market place that offer a limited degree of flexibility to alter and improve both original configurations and to alter air balance based on building usage or configuration changes. For the most part, these devices are installed in crawl spaces, attics, or above drop ceilings. Not only is the retrofit installation costly, but often it is compromised because it is an aftermarket product or application that is not optimized with the original design of the air distribution system. While this retrofit market is growing and seems to offer value, it has limitations. These limitations can be many, but in general the most impacting are limits to the flexibility of the newly installed systems to adapt to short term changes desirable in air distribution systems.

For example, a conference room is typically not used daily, but must have sufficient air flow to handle its air flow needs when in use. Therefore a room of this nature will typically have excess air flow a large percent of the time. In the residential application, kitchens, dinning areas, and living rooms often have a large percent of the overall square footage of the home. However, these rooms are often used in rather fixed blocks of time, but are typically supplied with a fixed air flow whether the room is in use or not. At a minimum, this leads to excess energy consumption and often leads to human discomfort in either these rooms or other rooms where air flow may be defined by the peak needs of these larger rooms.

A key market entry and penetration driver is the ability of a product to integrate into the retrofit market without costly additions or modifications to the existing systems and at the same time be compatible with manufacturing of new system devices for both commercial and residential applications. In addition to being functional, any air control or blocking device should fit within the confines of existing air distribution boxes installed in ceilings, walls, and floors of existing residential and commercial structures. This restriction substantially limits the nature of devices used to allow the control of air flow.

In residential application, many different air distribution box sizes exist, some square, others rectangular, and even others round. However, in a general sense, these air distribution "boxes" are typically scaled and sized in relationship to the size or diameter of the air delivery duct associated with them. Therefore for a given air volume, it is possible to broadly understand the likely size and nature of the air distribution box. Often the box is insulated to limit condensation during cooling periods and improve overall energy efficiency. This feature helps define the corresponding box dimension of a given duct size and therefore the air flow.

Square air distribution boxes have become more popular in the last few years and tend to be less variable in size. While it is not possible to limit options, typically one would find 8, 10, and 12 inch square air distribution boxes. These boxes would be used across the full range of duct sizes ranging from 5 through 10 inches. Unlike the rectangular box configuration, it is not common to distort or flatten ducts used with square boxes.

Not only must one consider the box width and length in the plane of the wall or ceiling surface, one must also consider that the box has a depth projection into the wall or ceiling, nominally 2¾ to 3¼ inches.

One can clearly see the challenge in finding a universal means, configuration, and size for a device to effectively reduce or close off the air flow across such a wide range of possible air distribution boxes. While one could suggest the challenge is less problematic with new installations, this is really not the case as most builders and contractors design and build using personal preference and experience and therefore altering constructions habits to enhance compatibility is not a realistic goal.

In order to minimize the number of different sizes and designs of an air flow device, it is necessary to understand the relationship between air flow volumes and most likely box sizes. While a single device size to fit all configurations is not feasible, the novelty of the disclosed design greatly limits the number of different sizes and configurations needed. One can also envision the challenge of achieving full closure of large ducts in small boxes without unduly restricting the full open condition. Thus, the embodiments of the present invention are directed to methods and apparatus that seeks to overcome these limitations.

SUMMARY OF THE INVENTION

The invention relates to a method and mechanism to control air flow through an air handling system. In one aspect, a flow control device for use in an air handling system is provided. The device includes a flow control member having segmented sliding gates, wherein the flow control member is configured to selectively control an air flow stream by moving the sliding gates into the path of the air flow stream. The device further includes a controller member configured to control the movement of the sliding gates. Furthermore, the device includes a communication member configured to send and receive signals regarding the control of the air flow stream. Additionally, the device includes a power member for supplying power to the flow control member, the controller member and the communication member.

In another aspect, a method of controlling an air flow stream in an air handling system is provided. The method includes the step of actuating a flow control device which causes the movement of segmented sliding gates into a path of the air flow stream. The method further includes the step of measuring the air flow stream through the flow control device. Furthermore, the method includes the step of adjusting the position of the segmented sliding gates along the path of the air flow stream in response to the measurement. Additionally, the method includes the step of monitoring the air flow stream through the flow control device.

In yet another aspect, a flow control device for use in an air handling system is included. The device includes a plurality of sliding gates configured to selectively restrict an air flow stream through the flow control device. The device further includes a controller configured to control the movement of the sliding gates. Additionally, the device includes a power generating assembly configured to generate energy for use in the movement of the sliding gates, wherein the power generating assembly utilizes a portion of the air flow stream to generate the energy.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 illustrates a method for energizing the stacked gates.

FIGS. 5*a, b* show the details of the wire drive catch system.

DETAILED DESCRIPTION

Figure 1:
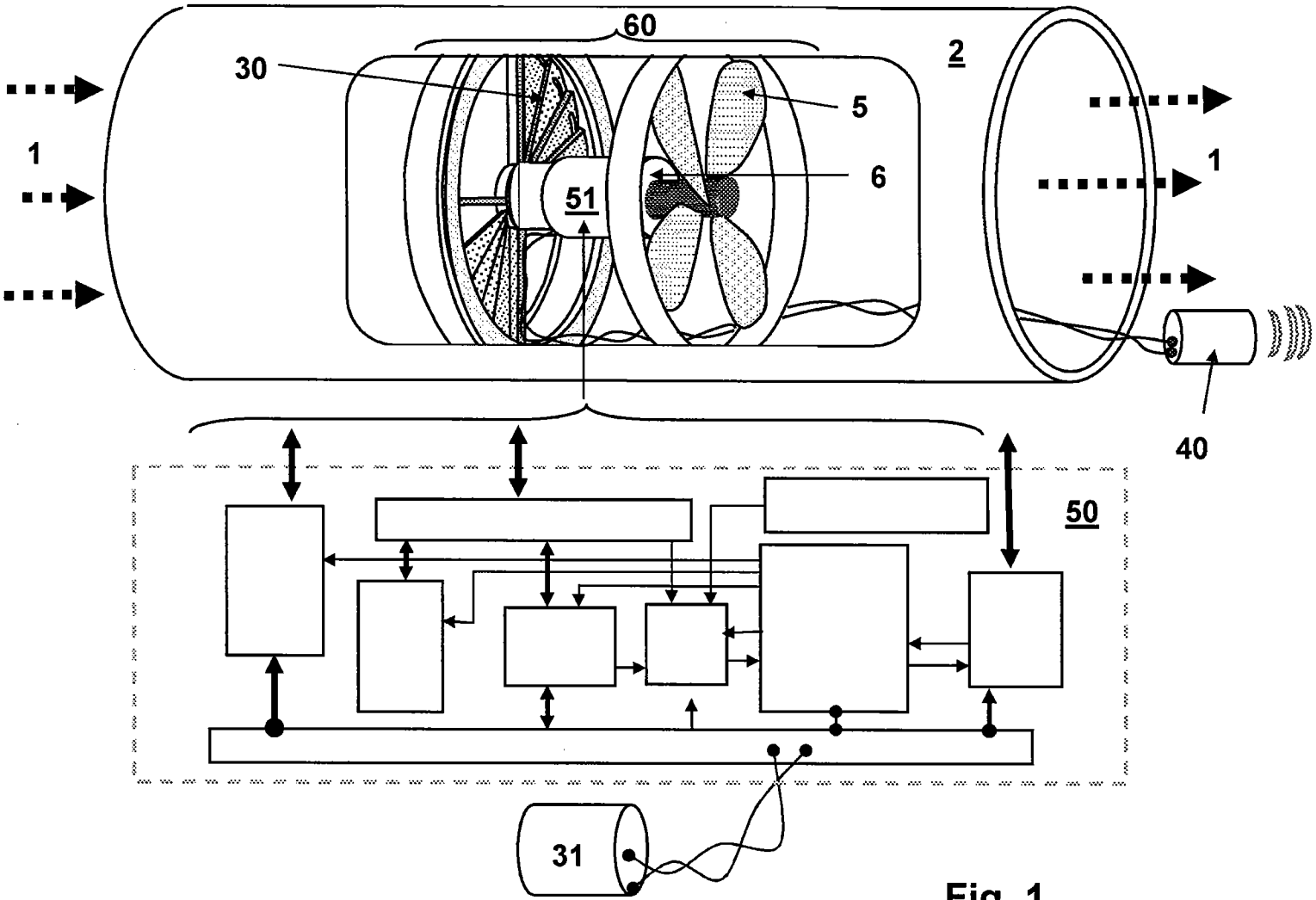
FIG. 1 shows illustrates a flow control device installed within a duct.

The present invention is generally directed to a method and apparatus for controlling the flow of air through a heating, ventilating, and air conditioning system. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same number indicator. The drawings may be, but are not necessarily to scale, and the proportions of certain parts have been exaggerated to better illustrate details and features of the invention. One of ordinary skill in the art of heating, ventilating, and air conditioning systems will appreciate that the embodiments of the invention can and may be used in various types of flow control systems.

The flow control device of this invention consists of a flow control member, a controller member, a power member, and a communications member. The flow control member is provided by one or more sets of gates which can be retracted into the lateral spaces of a conventional register box allowing unimpeded air flow through the unit. Conversely, by various drive mechanisms, the gates can be moved out of the lateral spaces and positioned to fully close off the air flow path thru the device. The controller member serves to provide control signals to the gate driver mechanism and provide communication to sensors and other devices in a complete system. The power member supplies the necessary energy to the device to operate effectively. The power member may be a simple power storage device like a battery, a wired connection to a low voltage supply, or a combined generator and storage system where the power is derived from the air flowing thru the device.

The communication member gives the device the capability of passing information to and from other devices in the system as appropriate. Commonly these devices would be sensors, other flow control devices, or central control units. The drive mechanism which moves the gates may be a cable system, a screw drive system of one or more screws, linear motor, one way drive with spring return, or a belt drive system. The coupling from the drive mechanism to the driven gate may be either a permanent mounting lug or a magnetic system.

A further aspect of this invention relates to a software control method which prevents the gates from remaining closed in the event of a power loss or drainage in systems utilizing a storage member such as batteries or capacitors. To circumvent the known limitations of such power storage monitoring systems, the invention uses predicted power requirements, current status measurements, and risk factors to assess the risk of closing the flow control member prior to executing such commands. The control algorithm may also keep a running tally of charge input vs. charge utilized to maintain an estimate of power reserve. As an additional safe guard to prevent closure during loss of power, the controller instructions monitor the HVAC system. On detection of loss of air flow (HVAC transitioned to the off state), the controller remembers the current position, then opens the flow control member if it is in a closed or restricted state. Should power levels in the storage system fall below required levels, during an HVAC off cycle, then the device is pre-positioned to allow air flow and if a power generation device is present, begin charging the power storage device when air flow returns. To better understand the aspects of the present invention and the methods of use thereof, reference is hereafter made to the accompanying drawings.

FIG. 1 illustrates a flow control device 60 installed within a duct 2 that is servicing a portion of a HVAC distribution network or an air handling system. An example of a flow control device is described in U.S. Pat. No. 7,347,774, which is herein incorporated by reference. The flow control device 60 is comprised of a flow restriction member 30 connected to a power generating source 6 by way of a controller housing 51. Within the controller housing is a control circuit 50 which operates the device. The control circuit 50 is connected to a communications member 40 which allows the flow control device to communicate with other units and remote sensors (not illustrated). Control circuit 50 is also connected to power storage device 31. In operation, fan 5 turns power generating source 6 which produces electric power which is routed by control circuit 50 to the power storage member 31. On appropriate conditions sensed by the control circuit 50, power is sent from the power storage 31 to activate the flow restriction member 30.

Figure 2A:
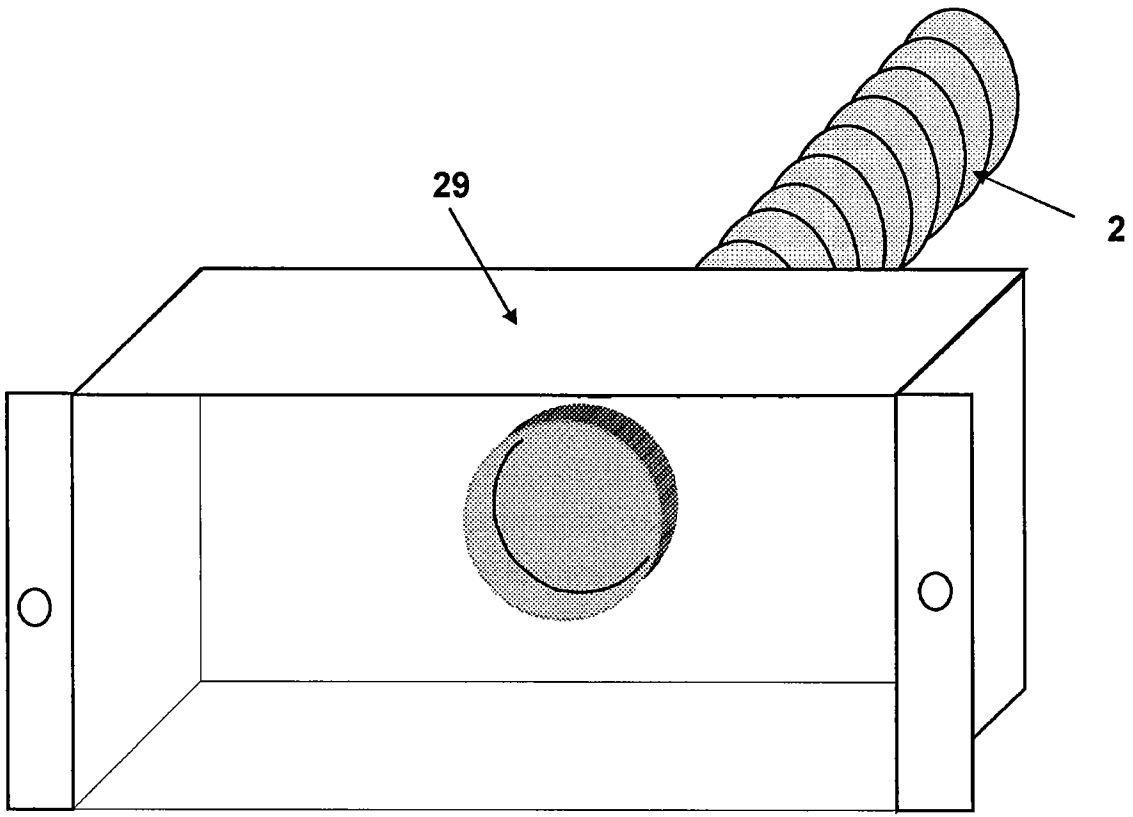
FIGS. 2*a, b, c, d* illustrate the gate valve concept within a conventional register box.

FIG. 2*a* illustrates the mounting space available within a conventional register box 29. Register box 29 is supplied conditioned air by way of duct system 2.

Figure 2B:
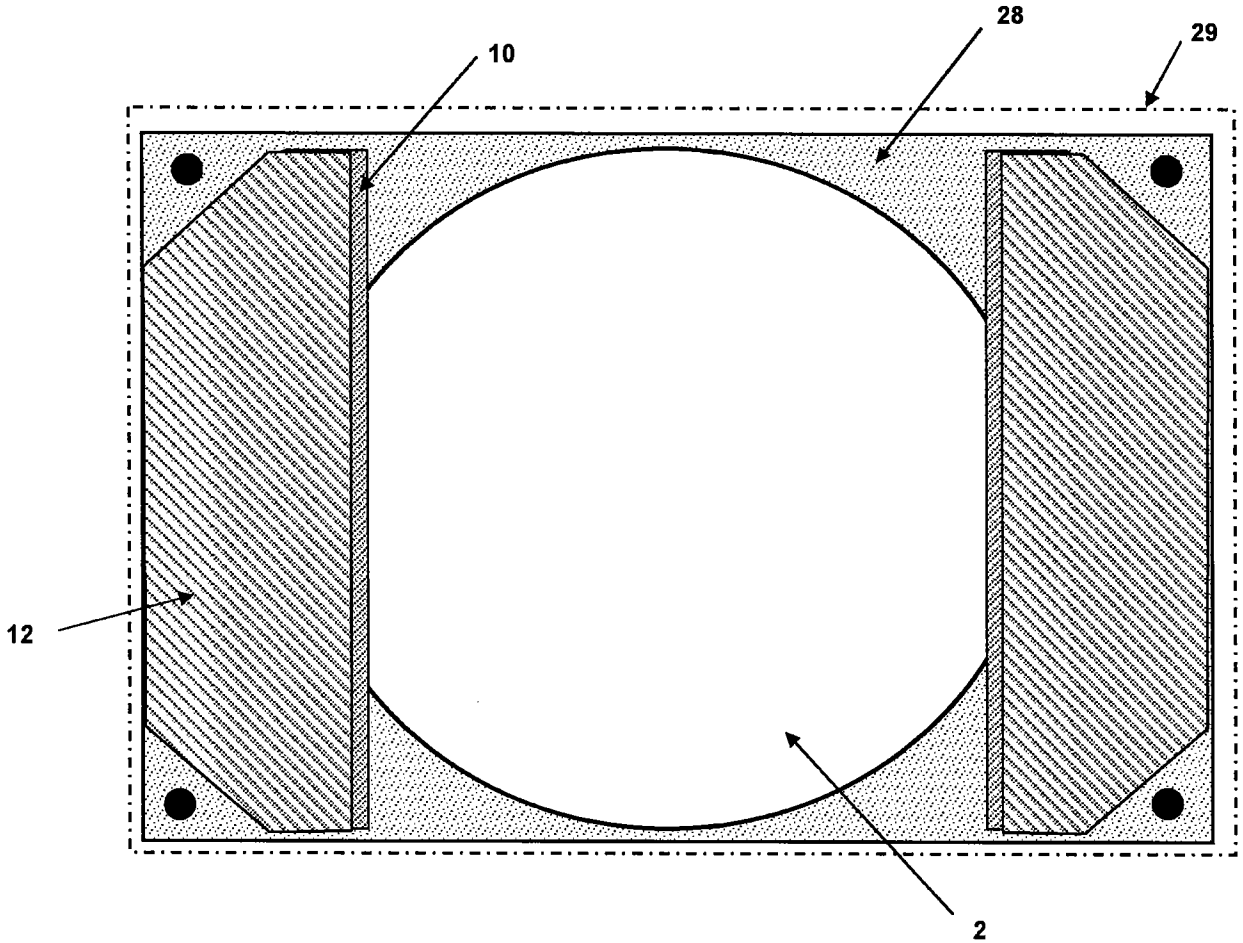

FIG. 2*b* illustrates the concept of an in-echelon gate system, where the upper gate 12 and lower gate 10 are retracted into the side spaces of the register box 29, gates 10, 12 are contained with in frame 28. Gates 10, 12 provide the flow control device 60 with a flow restriction member.

Figure 2C:
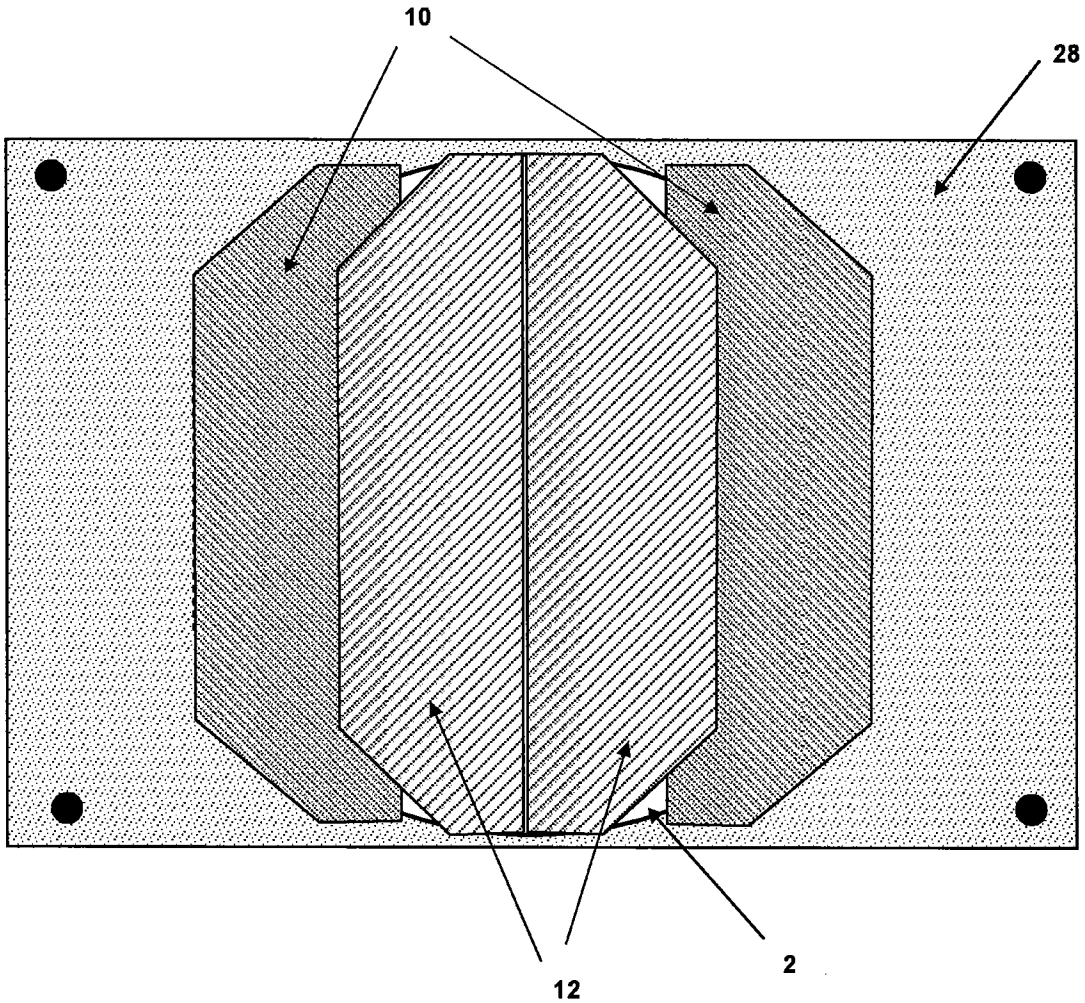

FIG. 2*c* shows these same upper gates 12 and lower gate 10, after being moved into the closed position.

Figure 2D:
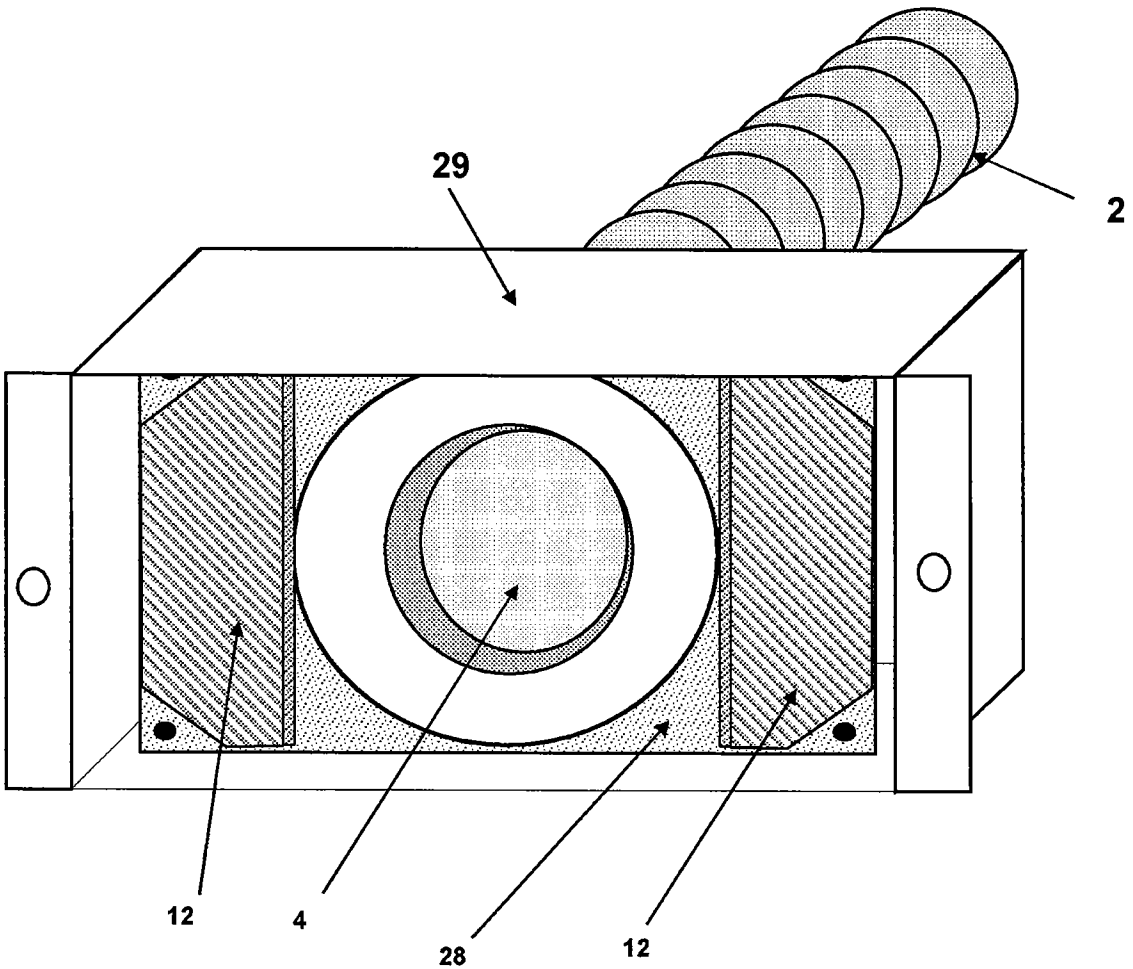

FIG. 2*d* shows the gate system installed with in the confines of register box 29, with the gates 10, 12 in the retracted position (10 is not visible) within the frame 28 allowing full access for air flow from a duct opening 4 at the distal end of duct system 2.

FIGS. 3*a, b* show one method of coupling the gate system. Lips on the leading and trailing edge of lower gate 10 contact a lip structure on the upper gate 12. In this manner, one only needs to drive the upper gate 12 to operate both gates.

Figure 4A:
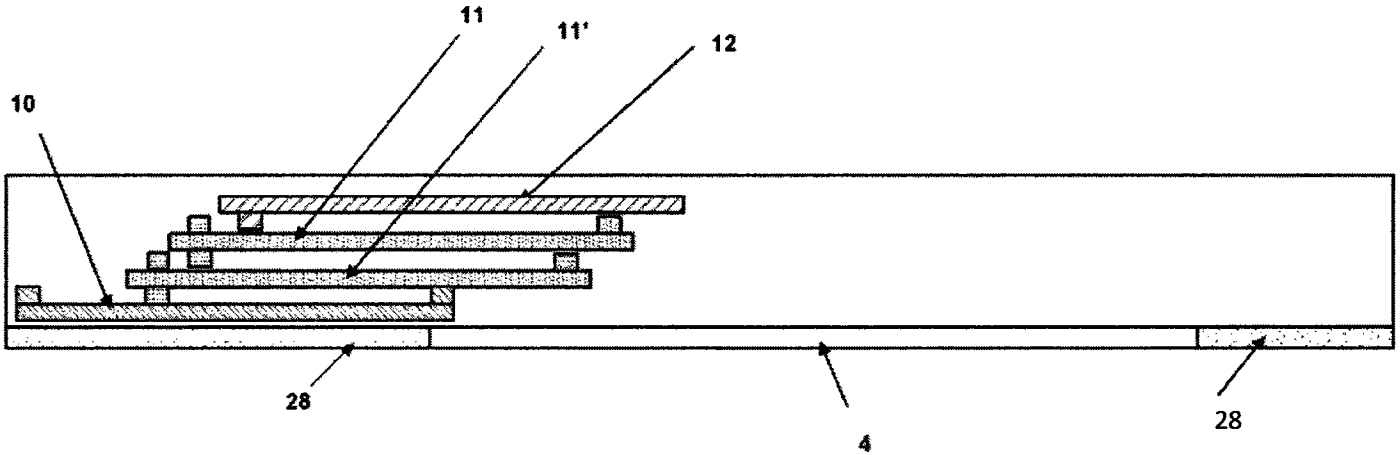
FIGS. 4*a, b* show a gate concept in a single sided application.
Figure 4B:
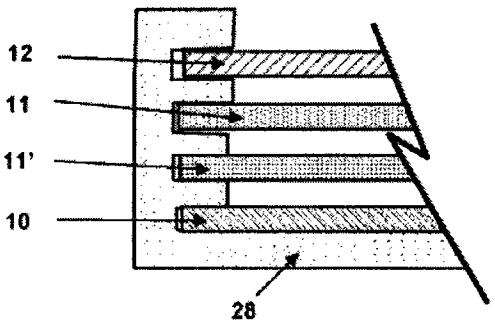

FIGS. 4*a, b* shows the extension of this concept to a one sided gate system where all gates reside on the same side when open. The upper gate 12 (also know as the driven gate), is operably in contact with slave gates 11, 11' and lower gate 10. All gates 10, 11, 11', 12 are held in place within the frame 28 by grooves.

FIGS. 5*a, b* illustrate a possible drive mechanism for actuating the gate type closure. The lower gate 10 is driven by drive wire 8 which is connected to lower gate 10 at stub 21. The drive wire 8 moves around the periphery of the flow control device 60 by way of pulleys 7, 7". The drive wire 8 passes through upper gate 12 at lug 22 and is not activated until drive wire block 9 contacts gate guide lug 22.

Figure 6:
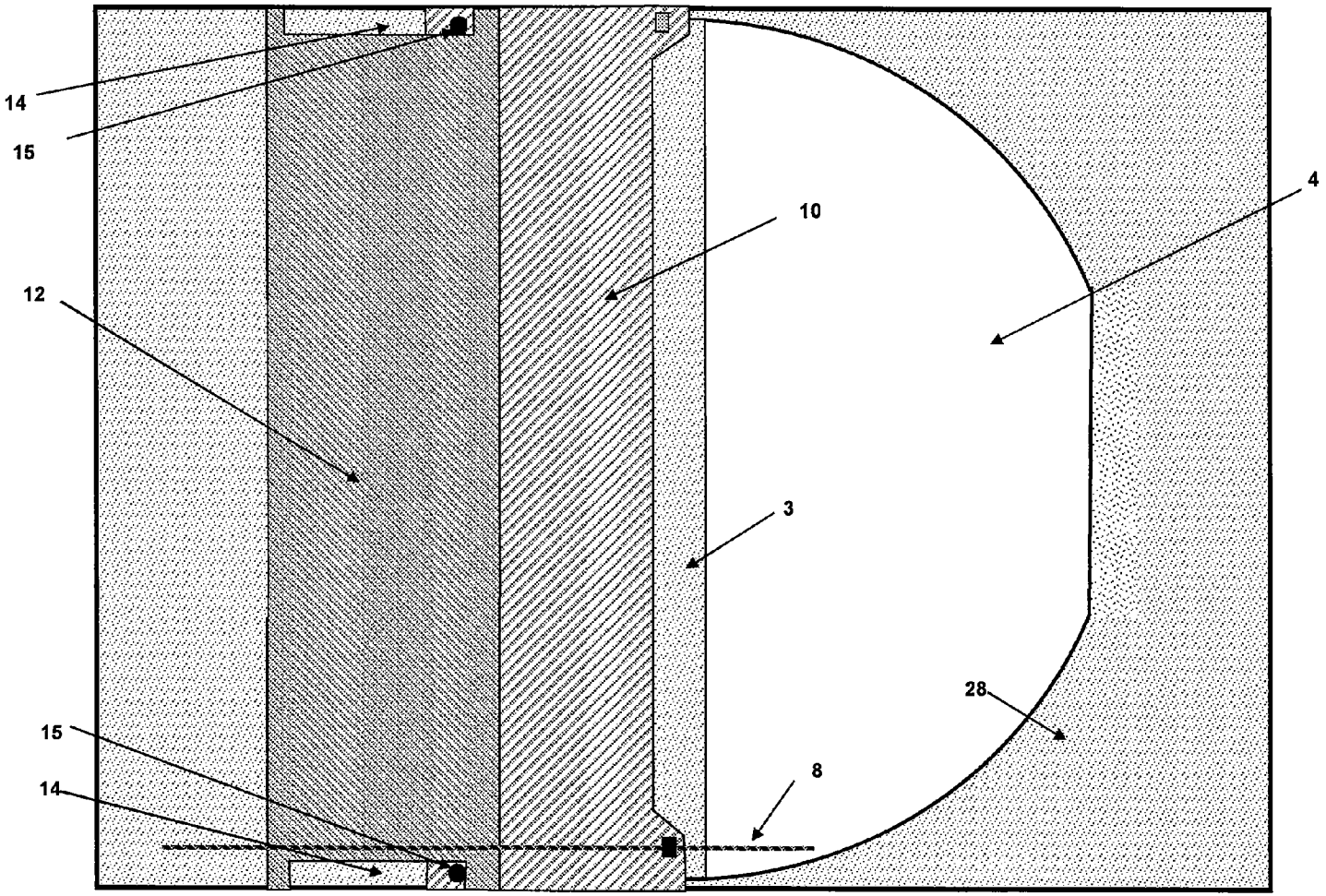
FIG. 6 shows an alternative tongue and groove method for moving the slave gate.

FIG. 6 shows and alternative method of operating the upper gate 12. Drive pins 15 are connected to lower gate 10 on both sides. Guide pins 15 ride inside drive slots 14 on upper gate 12. As the drive system moves lower gate 10 forward, upper gate 12 is dragged along.

Figure 7:
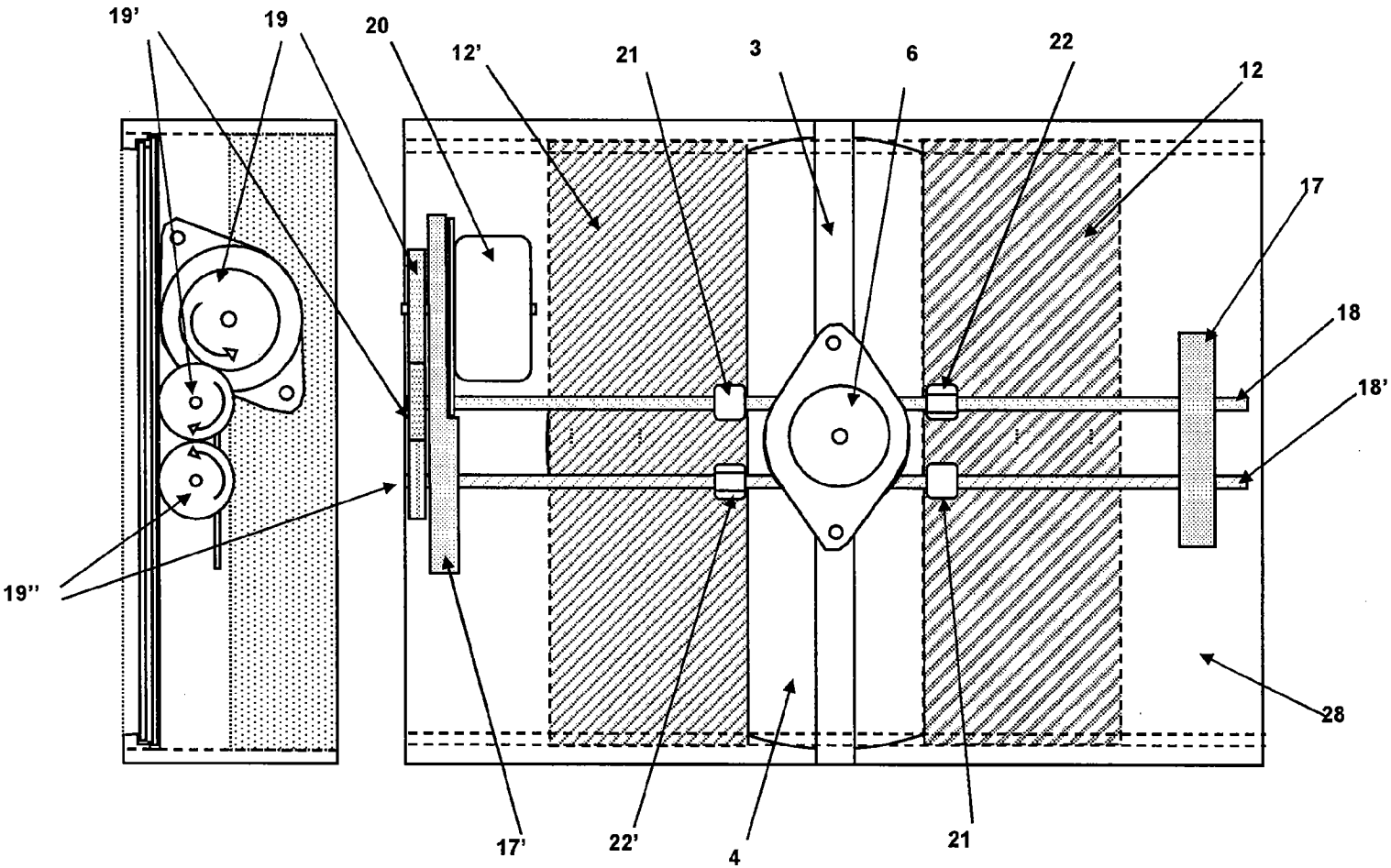
FIG. 7 illustrates a double screw drive method for moving gates.

FIG. 7 illustrates the use of drive screws 18, 18' to activate drive gates 12. Upper gates 12, 12' are connected to drive screws 18, 18' by way of gate drive lugs 21, 21'. The drive screws 18, 18' are supported in the frame 28 by drive screw mounting brackets 17, 17'. One side of the device drive gears 19', 19" are connected to the protrusion of drive screws 18, 18'. Drive gear 19' is in turn connected to drive gear 19 which is mounted on motor 20. The gears are such that on actuation of motor 20 the two drive screws 18, 18' turn in opposite directions. Each drive screw 18, 18' also passes through gate guide lug 22, 22' to maintain alignment of the gate in frame 28.

Figure 8:
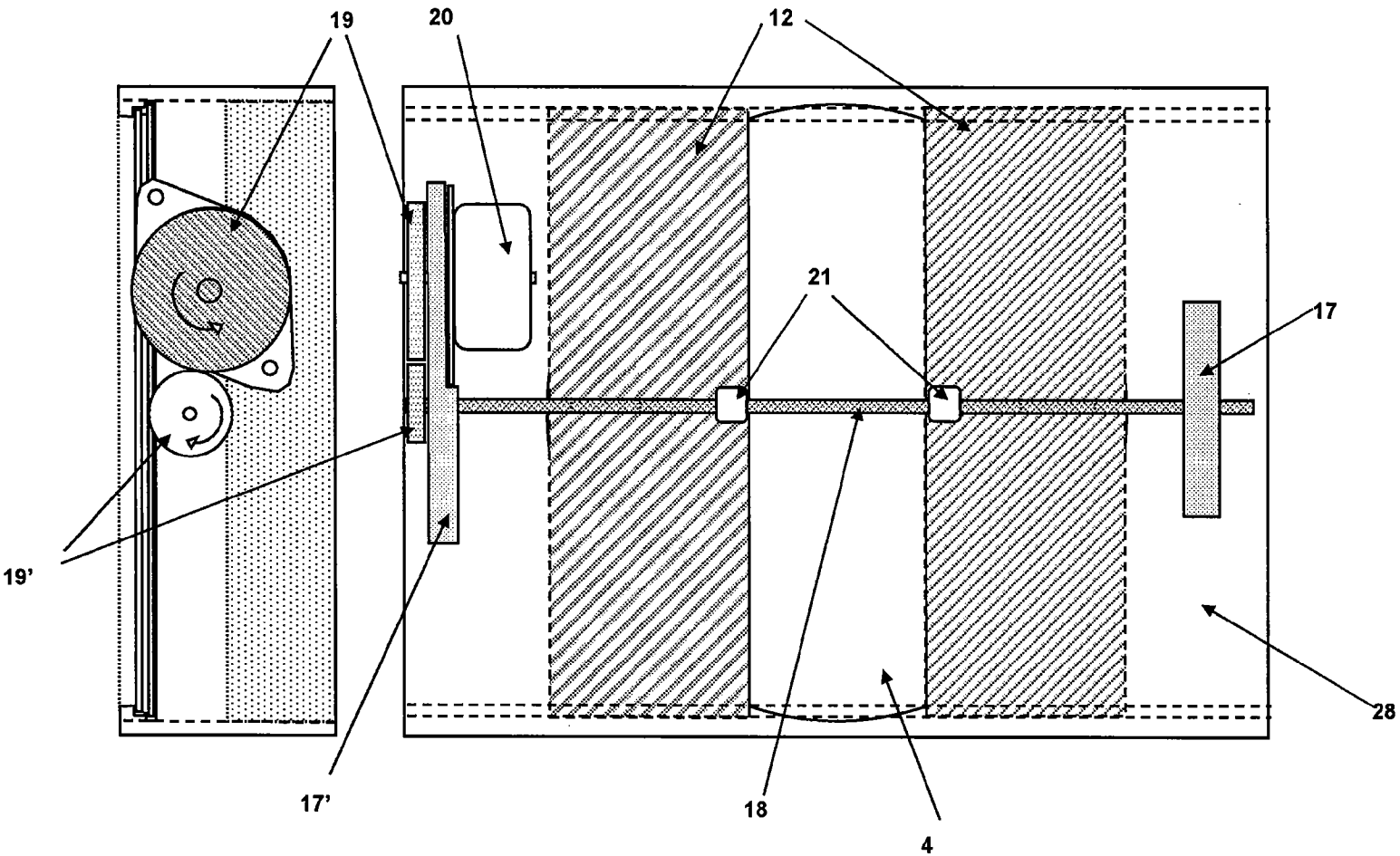
FIG. 8 shows a single screw method for gate operations.

FIG. 8 shows an alternative embodiment where the drive screws have been consolidated into a single cross threaded drive screw 18. Drive screw is supported by drive screw mounting 17, 17' and is connected to motor 20 by way of gear train 19, 19' as in the previous figure. In yet another embodiment, drive screw 18 can be threaded with ½ right hand and ½ left handed threads at opposite ends. (Not illustrated).

Figure 9:
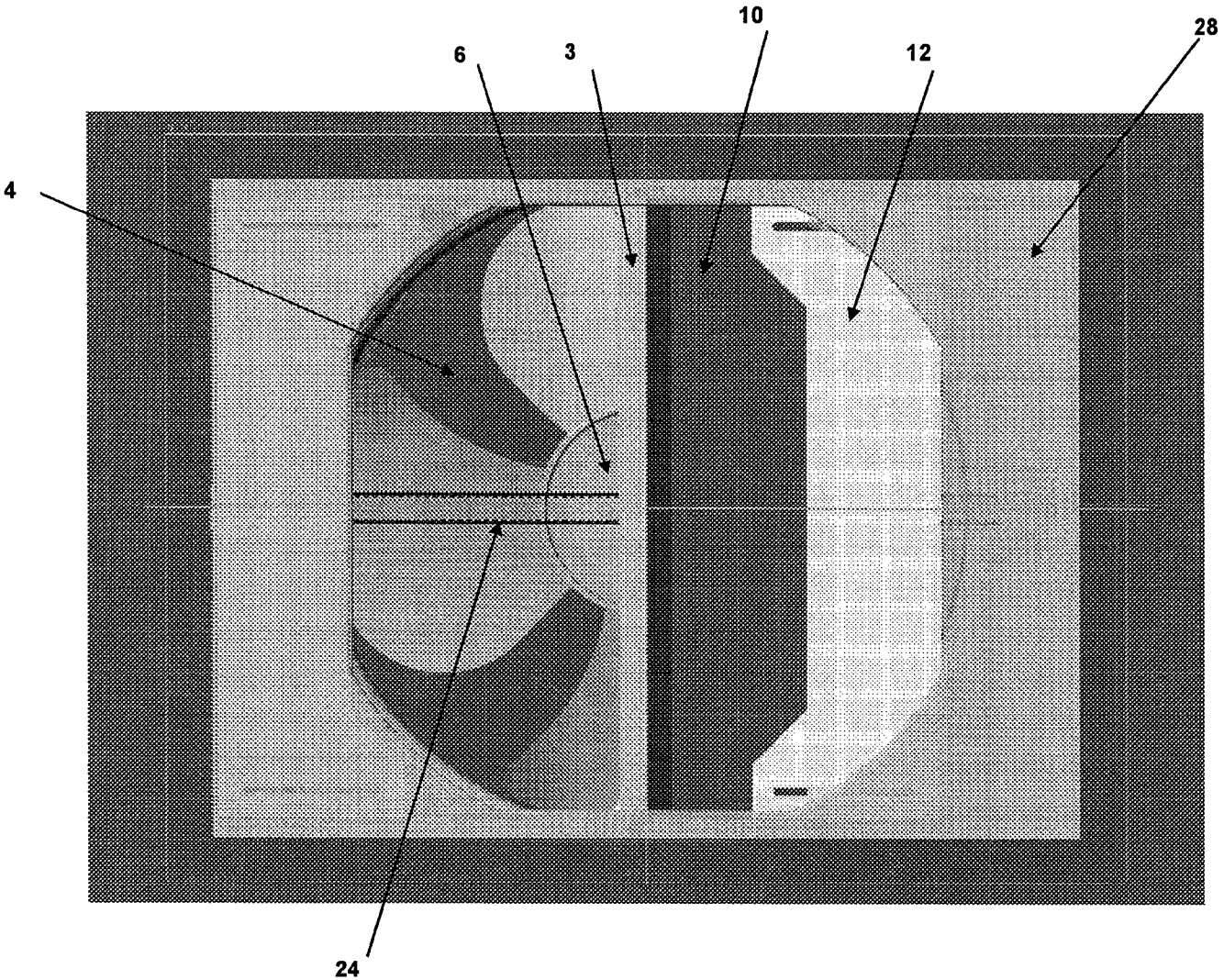
FIG. 9 illustrates the concept of a belt drive system.
Figure 10:
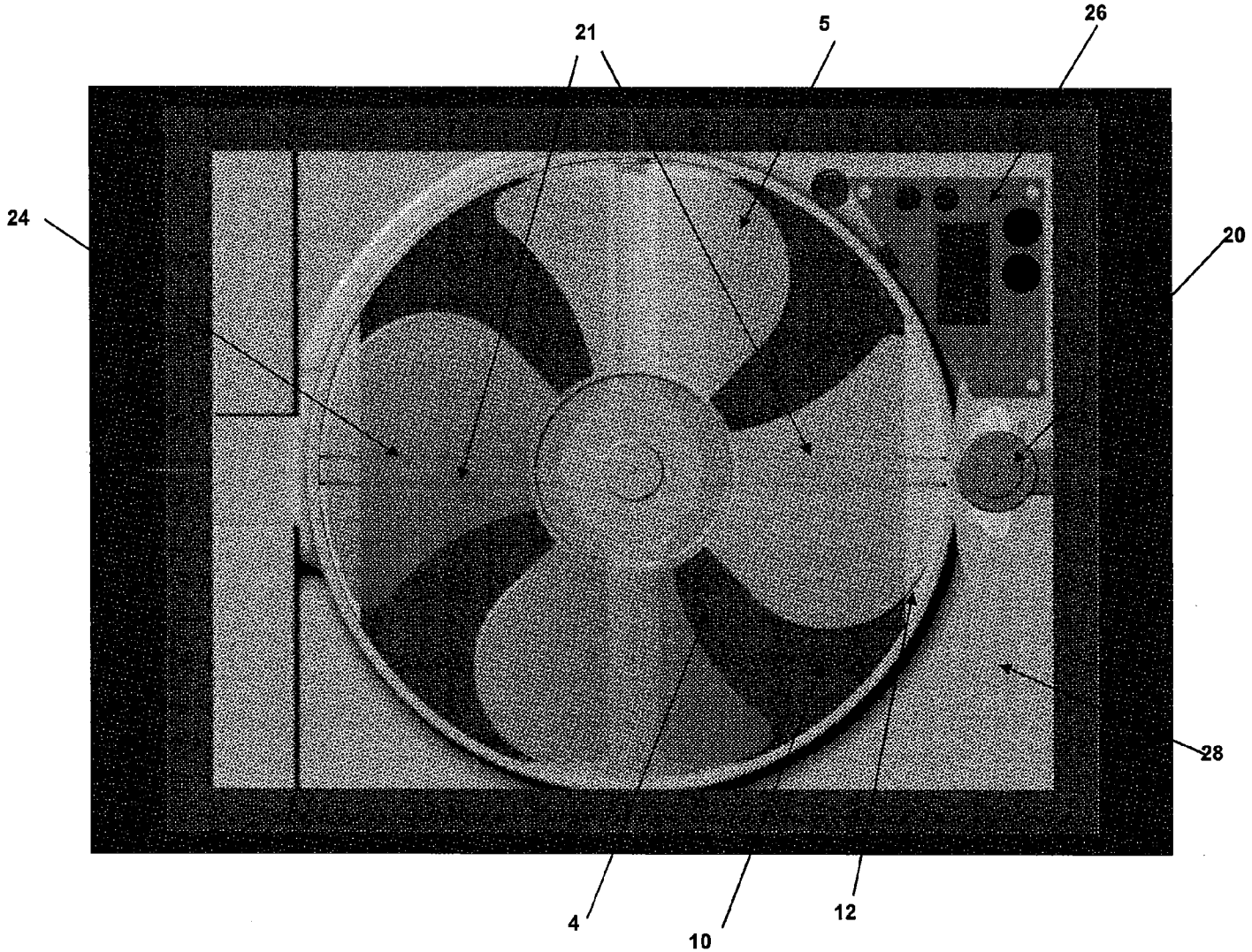
FIG. 10 shows an upstream view of the belt drive system with belt obscured by generator blades.

FIGS. 9 and 10 illustrate another embodiment of the drive system for the gate system. Here drive belt 24 is connected to the upper gate 12 by way of gate drive lug 21. The gate drive lug 21 may be either magnetically attached or molded into the gate 12 on manufacture. Drive belt 24 is connected to motor 20 either by direct drive or gear train (not visible in this view).

There are several other technologies which may be adapted to drive the gates open and closed such a device as described above. Among these are a linear motor or a rack and pinion drive system. Additionally any of the described systems may be engineered to use a one way drive mechanism and a spring return.

The operating concept of the entire flow control device as discussed in U.S. Pat. No. 7,347,774 is to vary the opening percentage of the gates to dynamically balance the air flow through a system of ducts. The above described gate system is an ideal way to implement this functionality. However, the gate concept can also be extended to other implementations which have central controller based reasoning.

Figure 11:
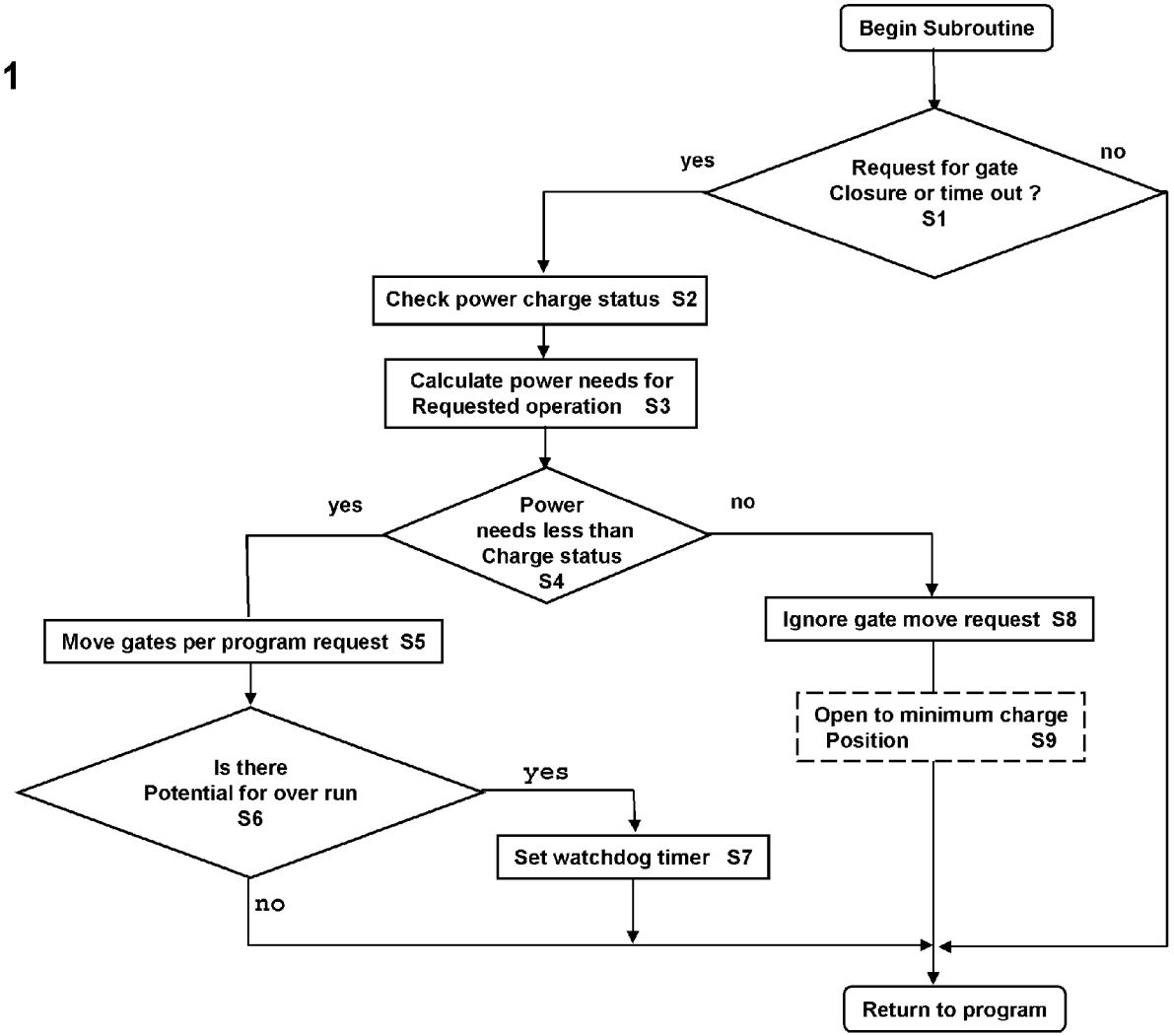
FIG. 11 illustrates a flow chart for gate actuation.
Figure 12:
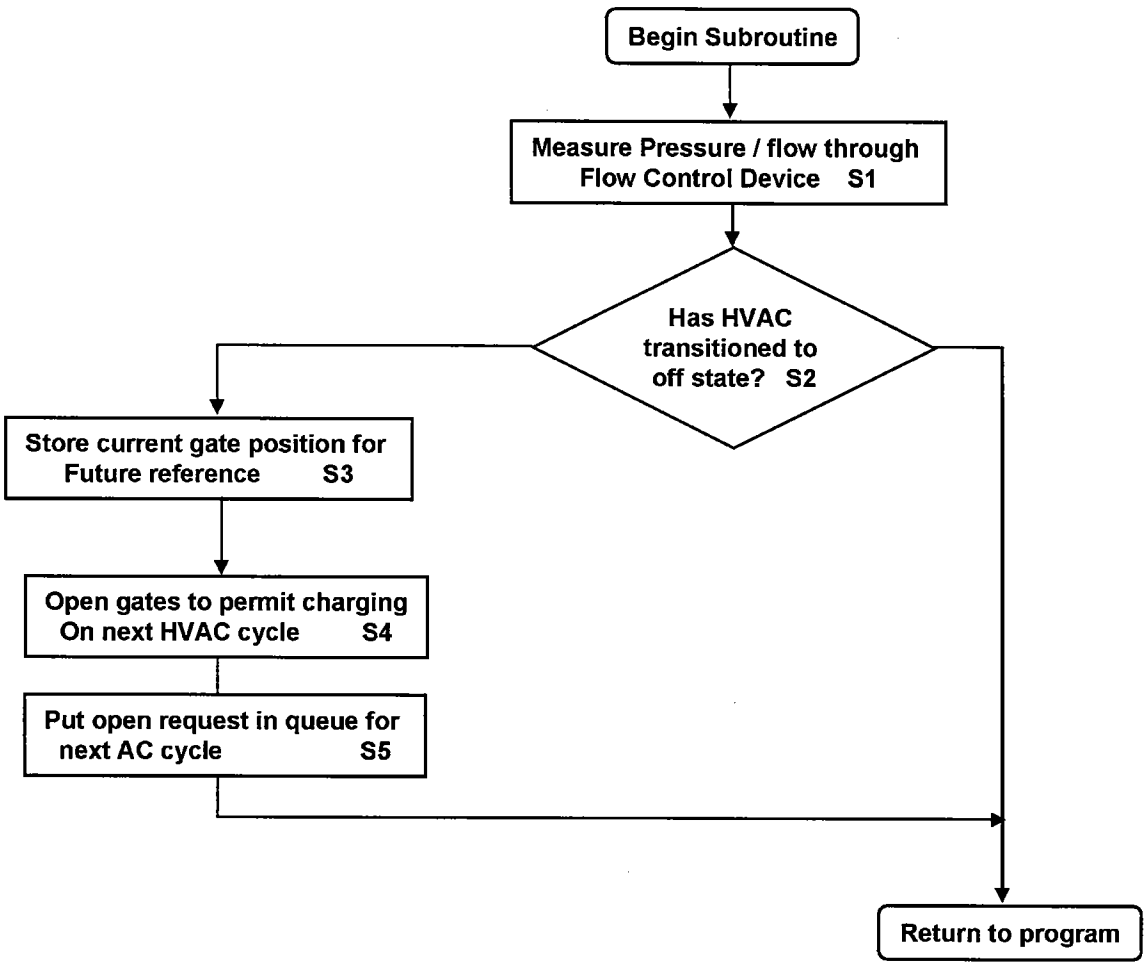
FIG. 12 illustrates a flow chart of safety subroutine to prevent inadvertent loss of power.

In any application where the local flow restriction device is operated using local stored energy or a local generator and storage system as described in U.S. Pat. No. 7,347,774, the possibility exists that the system could be left in the closed position for a time period which could exhaust the power storage and require human intervention to replace the storage device or manually open the flow restriction to allow the power generating system to recharge. Having the local controller simply monitor the local storage device energy level may not be particularly attractive option as many storage technologies do not give sufficiently accurate or reliable indications of remaining energy and the possibility of insufficient energy to open can occur. A control software solution is shown in FIGS. 11 and 12. In FIG. 11, before any operations are executed to move the flow restriction device to a new position, the local controller executes a subroutine which checks to see if the request is a closure action, S1. If yes, the controller proceeds to check the power status S2 and calculates if there is sufficient power in storage to execute the closure and another full opening, S3. If sufficient power with reserve estimates exists S4, then the controller continues to S5 and executes the request. Because certain requests might leave the device in a restricted position for an unknown time, the controller may set an internal watchdog timer S7 which will force the software back to check periodically. In the event the system detects less power than the expected requirements for the requested moves, the request for closure must be refused S8, and the restriction backed off to a minimum position which will allow the system to recharge if so equipped, S9.

In an alternative embodiment, the controller may monitor the balance of energy in the storage system, monitoring amounts of usage and charging to maintain an estimate of the remaining power available to be used in S2, FIG. 11.

Another fail safe needs to be in place for local power generating based power storage systems in the event the main HVAC unit remains in the off state for an extended period. FIG. 12 provides an example solution for this occurrence. Power generating storage systems have the ability to detect the flow of air from the HVAC system by the nature of energy being generated. Alternatively the flow control devices may be equipped with a pressure detector to sense the pressure associated with the HVAC being in the on state. If the system detects the HVAC has transitioned in to the off state S2, then the device simply stores the current flow restriction position S3, proceeds to open the restriction device to a sufficient amount to allow charging the storage device S4, and places a "return to position" request in the instruction queue for the next HVAC cycle to restore the position S5.

While the foregoing is directed to embodiments of the present invention, other and further embodiments of the invention may be devised without departing from the basic scope thereof, and the scope thereof is determined by the claims that follow.

The invention claimed is:

1. A flow control device for use in an air handling system, the device comprising:

a flow control member having segmented sliding gates that are movable along a linear path, the flow control member being configured to selectively control an air flow stream through a duct of the air handling system by moving the segmented sliding gates between a first position on the linear path in which the duct is covered by the segmented sliding gates, and a second position on the linear path in which the duct is completely open, wherein a first portion of the segmented sliding gates are stacked on one side of the duct and a second portion of the segmented sliding gates are stacked on another side of the duct in the second position;

a controller member configured to control the movement of the segmented sliding gates;

a communication member configured to send and receive signals regarding the control of the air flow stream; and a power member configured to supply power to the flow control member, the controller member, and the communication member.

2. The device of claim 1, wherein the controller member uses predictive power consumption and/or power monitoring to control a cycle of operation of the segmented sliding gates.

3. The device of claim 1, wherein the power member comprises capacitors.

4. The device of claim 1, wherein the communication member is configured to communicate with a thermostat and/or other flow control devices in the air handling system.

5. The device of claim 1, wherein the segmented sliding gates are movable via a belt system.

6. The device of claim 1, wherein the segmented sliding gates are movable via a cable system.

7. The device of claim 1, wherein the segmented sliding gates are movable via a screw member.

8. The device of claim 7, wherein the screw member is cross threaded with both right and left hand threads.

9. The device of claim 7, wherein the screw member includes partial right and partial left hand threads.

10. The device of claim 1, wherein the segmented sliding gates are movable via a rack and pinion arrangement.

11. The device of claim 1, wherein the segmented sliding gates are movable via a motor.

12. The device of claim 1, wherein the segmented sliding gates are movable via a one way drive with a spring return.

13. The device of claim 1, wherein the controller is configured to move the segmented sliding gates to the second position when the air handling system transitions into an off state to allow charging of the power member.

14. The device of claim 1, further comprising a power generating assembly which uses the air flow stream to generate power for the power member.

15. A method of controlling an air flow stream through a duct of an air handling system, the method comprising:

actuating a flow control device which causes the movement of segmented sliding gates along a linear path between a first position on the linear path in which the duct is covered by the segmented sliding gates, and a second position on the linear path in which the duct is completely open, wherein a first portion of the segmented sliding gates are stacked on one side of the duct and a second portion of the segmented sliding gates are stacked on another side of the duct in the second position;

measuring the air flow stream through the flow control device;

adjusting the position of the segmented sliding gates along the linear path in response to the measurement; and monitoring the air flow stream through the flow control device.

16. The method of claim 15, further comprising receiving a signal from a thermostat in the in the air handling system relating to the control of the air flow stream through the flow control device.

17. The method of claim 15, further comprising generating energy for the actuation of the flow control device by using the air flow stream.

18. The method of claim 15, further comprising determining an off state of the air handling system and moving the segmented sliding gates to the second position to allow the charging of a power member in the flow control device.

19. A flow control device for use in controlling an air flow stream through a duct of an air handling system, the device comprising:

a plurality of sliding gates configured to selectively restrict the air flow stream through the duct of the air handling system, the sliding gates being configured to move along a linear path between a first position on the linear path in which the duct is covered by the sliding gates, and a second position on the linear path in which the duct is completely open, wherein a first portion of the sliding gates are positioned on one side of the duct and a second portion of the sliding gates are positioned on another side of the air flow stream in the second position;

a controller configured to control the movement of the sliding gates; and a power generating assembly configured to generate energy for use in the movement of the sliding gates, wherein the power generating assembly utilizes a portion of the air flow stream to generate the energy.

20. A flow control device for use in an air handling system, the device comprising:

a flow control member having segmented sliding gates that are movable along a linear path, the flow control member being configured to selectively control an air flow stream through a duct of the air handling system by moving the segmented sliding gates between a first linear position in which the duct is covered by the segmented sliding gates, and a second linear position in which the duct is completely open, wherein the segmented sliding gates include an upper gate and a lower gate, and wherein a lip structure at a first end and a second end of the upper gate interacts with a lip structure at a first end and a second end of the lower gate as the segmented sliding gates move between the first linear position and the second linear position; and a controller member configured to control the movement of the segmented sliding gates;

a communication member configured to send and receive signals regarding the control of the air flow stream; and a power member configured to supply power to the flow control member, the controller member, and the communication member.

* * * * *

UNITED STATES PATENT AND TRADEMARK OFFICE

CERTIFICATE OF CORRECTION

PATENT NO. : 8,535,126 B2
APPLICATION NO. : 12/369668
DATED : September 17, 2013
INVENTOR(S) : Fincher et al.

It is certified that error appears in the above-identified patent and that said Letters Patent is hereby corrected as shown below:

In the Specification

Column 1, Line 56, please delete “dinning” and insert --dining-- therefor;

Column 5, Line 27, please delete “know” and insert --known-- therefor.

Signed and Sealed this
Nineteenth Day of November, 2013

Teresa Stanek Rea

Teresa Stanek Rea
*Deputy Director of the United States Patent and Trademark Office*